US012680796B1

(12) United States Patent
Rascon et al.

(10) Patent No.: US 12,680,796 B1
(45) Date of Patent: Jul. 14, 2026

(54) PREFORMED COMPOSITE FRAGMENTATION WARHEAD

(71) Applicant: Raytheon Company, Arlington, VA (US)

(72) Inventors: John Rascon, Tucson, AZ (US); Jean Chauvel, Marana, AZ (US); Itthipol B. Chanapan, Vail, AZ (US)

(73) Assignee: Raytheon Company, Arlington, VA (US)

( * ) Notice: Subject to any disclaimer, the term of this patent is extended or adjusted under 35 U.S.C. 154(b) by 0 days.

(21) Appl. No.: 19/018,914

(22) Filed: Jan. 13, 2025

(51) Int. Cl.
*F42B 12/32* (2006.01)

(52) U.S. Cl.
CPC ..... *F42B 12/32* (2013.01)

(58) Field of Classification Search
CPC ..... F42B 12/32
See application file for complete search history.

(56) References Cited

U.S. PATENT DOCUMENTS

| | | | | |
|---|---|---|---|---|
| 4,745,864 | A | 5/1988 | Craddock | |
| 8,176,849 | B1 * | 5/2012 | Gold | F42B 12/32 102/491 |
| 10,018,453 | B1 | 7/2018 | Mccoy et al. | |
| 11,965,723 | B2 | 4/2024 | Beal | |
| 12,072,171 | B1 * | 8/2024 | Bonnstetter | F42B 12/24 |
| 2005/0183617 | A1 | 8/2005 | Macdougall | |
| 2011/0094408 | A1 | 4/2011 | Dupont et al. | |
| 2016/0377398 | A1 * | 12/2016 | Daebelliehn | F42B 12/26 29/428 |
| 2023/0103234 | A1 * | 3/2023 | Murchison | F42B 12/74 102/439 |

FOREIGN PATENT DOCUMENTS

| | | | |
|---|---|---|---|
| DE | 4210931 | C1 | 5/2000 |
| WO | WO-2019177500 | A1 | 9/2019 |

OTHER PUBLICATIONS

MSC Petkov, P.S., et al., "Optimization of the Design of Fragmentation Warheads Forming an Axial Flow of Preformed Fragments", International Scientific Journal "Security & Future", Year III, Issue 4, (2019), 178-181.

"International Application Serial No. PCT US2026 010918, International Search Report mailed May 6, 2026", 3 pgs.

"International Application Serial No. PCT US2026 010918, Written Opinion mailed May 6, 2026", 6 pgs.

* cited by examiner

*Primary Examiner* — J. Woodrow Eldred
(74) *Attorney, Agent, or Firm* — Schwegman Lundberg & Woessner, P.A.

(57) ABSTRACT

A preformed composite fragmentation warhead includes preformed composite fragments tightly packed around a casing that includes an explosive. The preformed composite fragments include an inner core encapsulated with an outer jacket. The inner core and outer jacket are formed from different metal materials with the density of the material for the outer jacket being lower than the density of the material for the inner core. Upon contact with a "soft" target, the outer jacket deforms and widens to increase the diameter of the preformed composite fragment. Upon contact with a "hard" target, the outer jacket erodes or shatters allowing the inner core to penetrate the hard target. The outer jacket also serves to reduce spalling upon detonation of the warhead explosive. The outer jacket fully encapsulates the inner core to ensure that the outer jacket impacts the target.

19 Claims, 9 Drawing Sheets

PREFORMED COMPOSITE FRAGMENTATION WARHEAD

BACKGROUND

Field

This disclosure relates to fragmentation warheads and more particularly to the use of preformed composite fragments to enhance the warhead's lethality value, known as the Probability of Kill (Pk), against a mixture of hard and soft targets.

Description of the Related Art

As described in U.S. Pat. No. 4,745,864 entitled "Explosive Fragmentation Structure" fragmentation structures, such as fragmentation warheads, mines, etc., are employed by the military against a wide variety of targets where dispersion of fragments over a target area is required. A problem which arises in their use is that fragmentation warheads suitable for use against "soft" targets such as personnel or infrastructure are generally not suitable for use against "hard" targets such as armored vehicles and emplacements, where fragments of relatively greater size and mass are required. Military units have therefore been required to maintain supplies of several types of fragmentation warheads, each type adapted for use against a particular type of target. This results in an increased burden of logistics and supply and is, of course, highly undesirable. In the past, it has been attempted to minimize this problem by constructing warheads having two sections, one section being adapted to disperse fragments of one size and the other being adapted to disperse fragments of another size. In this manner, a single warhead may be utilized against a variety of targets. Such a construction, however, is inefficient in that, in each case, portions of the warhead not designed for the particular application are largely ineffective; furthermore, in order to produce a given amount of destructive force, a warhead of larger dimensions is necessary than would be the case for one designed for the specific application.

Other problems related to the construction of fragmentation warheads have involved the expense of machining or casting a multiplicity of grooves or openings in the metal casings to induce fragmentation of the casing in a desired pattern by establishing preferential fracture lines. Alternatively, an inner casing having openings or grooves formed therethrough is disposed within an outer metal casing and configured such that it directs explosive shock waves from an internal explosive charge against the outer casing in a grid-like pattern, such that the outer casing is fractured along the grid lines. In all cases, the molding, machining, or forging of metal structures into a desired, grid-like pattern is undesirably expensive, particularly when large quantities of weapons are to be manufactured, and does not guarantee fracturing into the desired sizes.

A preformed fragmentation warhead is a weapon that contains preformed fragments positioned on or in the casing that are designed to be released when the warhead detonates. The preformed fragments are usually made of a relatively high-density material such as steel or tungsten and are shaped like cubes, spheres or rods. The casing is formed of a low-density material such as plastic or aluminum that largely disintegrates when the warhead detonates.

Spalling is a problem that is common to all explosive fragmentation warheads. Detonation of the explosive generates a high shock that propagates through the metal casing or preformed fragments producing higher pressures than the ultimate tensile strength of the metal material, which causes some of the material to break off and degrade the fragments and their effectiveness against hard or soft targets.

SUMMARY

The following is a summary that provides a basic understanding of some aspects of the disclosure. This summary is not intended to identify key or critical elements of the disclosure or to delineate the scope of the disclosure. Its sole purpose is to present some concepts of the disclosure in a simplified form as a prelude to the more detailed description and the defining claims that are presented later.

The present disclosure provides a preformed composite fragmentation warhead in which preformed composite fragments are tightly packed around a casing that includes an explosive. The preformed composite fragments include an inner core encapsulated with an outer jacket. The inner core and outer jacket are formed from different metal materials with the density of the material for the outer jacket being lower than the density of the material for the inner core. Upon contact with a "soft" target, the outer jacket deforms and widens to increase the diameter of the preformed composite fragment. Upon contact with a "hard" target, the outer jacket erodes or shatters allowing the inner core to penetrate the hard target. The outer jacket also serves to reduce spalling upon detonation of the warhead explosive. The outer jacket fully encapsulates the inner core to ensure that the outer jacket impacts the target regardless or orientation upon impact.

In different embodiments, the inner core may take on any arbitrary three-dimensional shape including but not limited to cubes, rods, spheres, rectangular prisms or pyramids. The preformed composite fragments may be mixed and matched to increase the number of fragments, the diversity of fragments, balance the number of fragments and fragment mass to a weight budget and increase the packing efficiency. The outer jacket may or may not have the same shape as the inner core. The outer jacket may have the same shape to maintain the center-of-gravity (Cg) of the inner core. The outer jacket may have a different shape to either move the Cg to reduce tumbling or to facilitate packing around the casing. The inner core occupies 25-60% and the outer jacket 40-75% of the total volume of the preformed composite fragment.

In different embodiments, the density of the inner core material is 10-23 g/cm$^3$ and the density of the outer jacket material is 2.3-9.5 g/cm$^3$. The inner core material is suitably selected from tungsten (19.3 g/cm$^3$), molybdenum (10.2 g/cm$^3$) lead (11.34 g/cm$^3$), tantalum (16.65 g/cm$^3$) or depleted uranium (19.07 g/cm$^3$). The outer jacket material is suitably selected from steel (7.85 g/cm$^3$), aluminum (2.7 g/cm$^3$), titanium (4.51 g/cm$^3$) or copper (8.96 g/cm$^3$).

In different embodiments, the preformed composite fragments are tightly packed around the casing on an outer surface of the casing, within the walls of the casing, on an inner surface of the casing or a combination thereof.

These and other features and advantages of the disclosure will be apparent to those skilled in the art from the following detailed description of preferred embodiments, taken together with the accompanying drawings, in which:

DETAILED DESCRIPTION

The present disclosure provides a preformed composite fragmentation warhead in which preformed composite fragments are tightly packed around a casing that includes an explosive. The preformed composite fragments include an inner core encapsulated with an outer jacket. The inner core and outer jacket are formed from different metal materials with the density of the material for the outer jacket being lower than the density of the material for the inner core. Upon contact with a "soft" target, the outer jacket deforms and widens to increase the diameter of the preformed composite fragment. Upon contact with a "hard" target, the outer jacket erodes or shatters allowing the inner core to penetrate the hard target. The outer jacket also serves to reduce spalling upon detonation of the warhead explosive. The outer jacket fully encapsulates the inner core to ensure that the outer jacket impacts the target regardless of orientation.

Figure 1B:
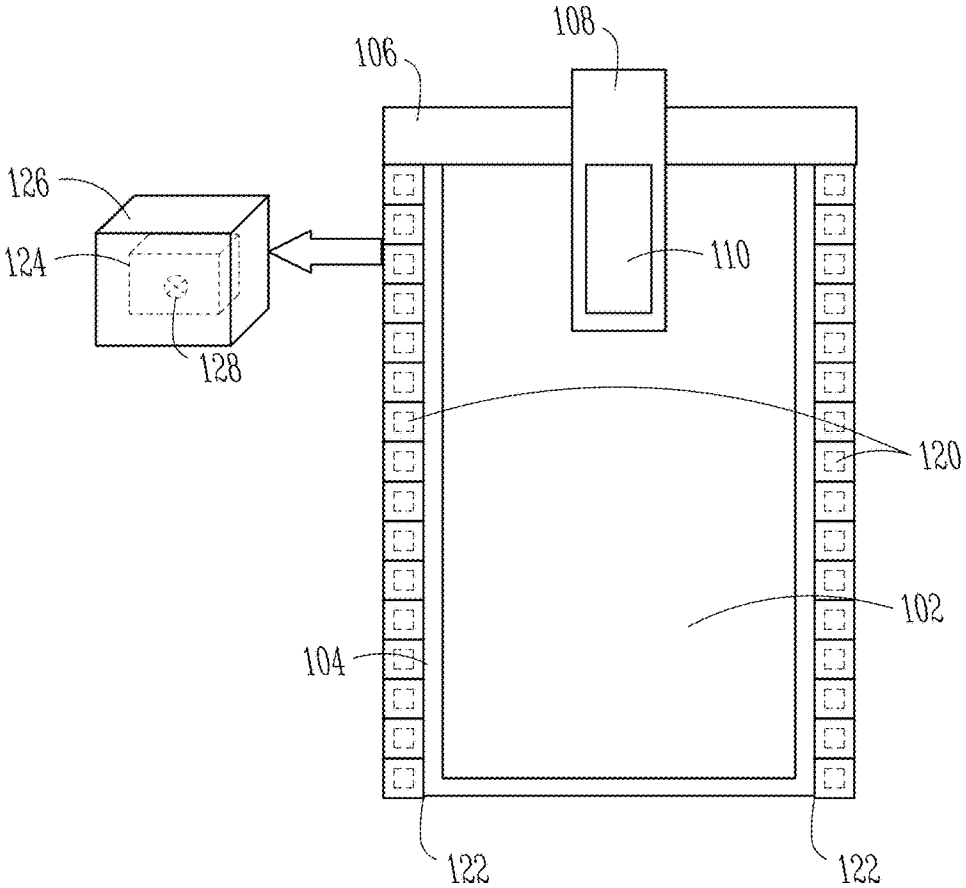
FIGS. 1A-1B are perspective and cross-section views of an embodiment of a preformed composite fragmentation warhead in which preformed composite fragments are tightly packed around an outer surface of the warhead casing.
Figure 1A:
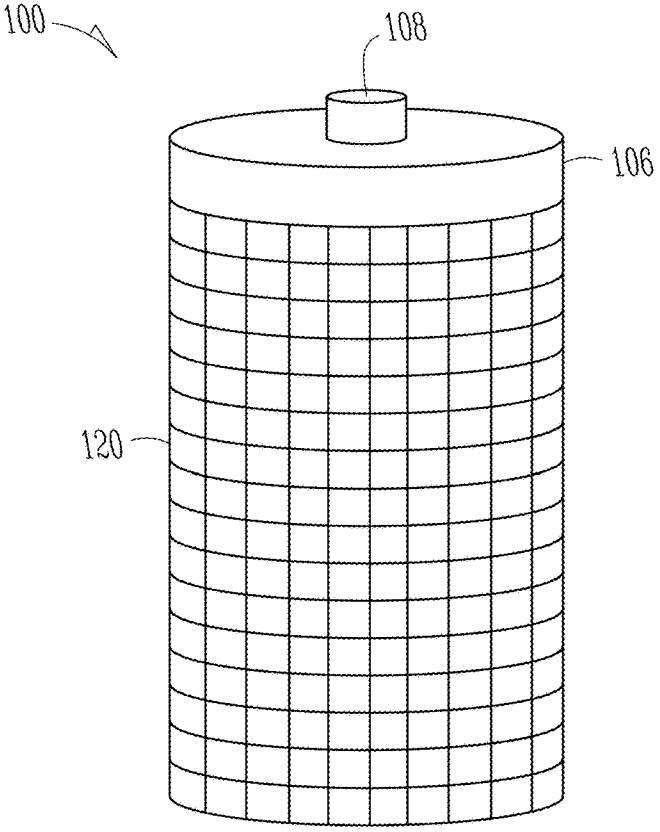

Referring now to FIGS. 1A-1B, an embodiment of a preformed composite fragmentation warhead 100 includes a high explosive 102 positioned inside a casing 104. A lid 106 is placed over high explosive 102 at an open end of casing 104. An initiation device 108, which may include a booster explosive 110 extends through lid 106 along a long axis of high explosive 102. Other configurations and initiation devices may be used to detonate the warhead. Casing 104 is typically formed from a low-density material such as aluminum or plastic that largely vaporizes upon detonation.

A plurality of preformed composite fragments 120 are tight packed around an outer surface 122 of casing 104. Each preformed composite fragment 120 includes an inner core 124 encapsulated within an outer jacket 126. The inner core 124 is formed from a material having a higher density than the material that provides outer jacket 126.

The density of the outer jacket material is 10-20 g/cm$^3$ and the density of the inner core material is 2.3-9.5 g/cm$^3$. The inner jacket material is suitably selected from tungsten (19.3 g/cm$^3$), molybdenum (10.2 g/cm$^3$), lead (11.34 g/cm$^3$), tantalum (16.65 g/cm$^3$) or depleted uranium (19.07 g/cm$^3$). The outer jacket material is suitably selected from steel (7.85 g/cm$^3$), aluminum (2.7 g/cm$^3$), titanium (4.51 g/cm$^3$) or copper (8.96 g/cm$^3$).

The inner core 124 occupies 25-60% and the outer jacket 126 40-75% of the total volume of the preformed composite fragment 120.

The outer jacket 126 also serves to reduce spalling of the inner core 124 upon detonation of the high explosive 102.

In different embodiments, the inner core may take on any arbitrary three-dimensional shape including but not limited to cubes, rods, spheres, rectangular prisms or pyramids. The preformed composite fragments may be mixed and matched to increase the number of fragments, the diversity of fragments, balance the number of fragments and fragment mass to a weight budget and increase the packing efficiency. The outer jacket may or may not have the same shape as the inner core. The outer jacket may have the same shape to maintain the center-of-gravity (Cg) 128 of the inner core. The outer jacket may have a different shape to either move the Cg to reduce tumbling or to facilitate packing around the casing.

As shown in FIG. 1B, inner core 124 is a cube that is encapsulated in outer jacket 126 that is also a cube of larger dimensions. Inner core 124 is centered within outer jacket 126 such that the Cg 128 of inner core 124 is maintained for preformed composite fragment 120. This may be done to preserve the aerodynamic stability of the inner core 124 or to facilitate tight packing of the preformed composite fragments 120 around the casing.

In different embodiments, the preformed composite fragments 120 may have a variety of sizes and shapes that are tightly packed around the casing.

The configuration of an individual preformed composite fragment 120, the homogenous or heterogenous composition of preformed composite fragments 120 and the total number of preformed composite fragments depends on several factors including but not limited to the size of the warhead, the weight budget for the fragments and the mission (e.g., a specific soft target, a specific hard target or general-purpose applicability to hard and soft targets). The lethality value (Pk) against a given target may depend on such factors as the design of an individual fragment (e.g., the selection of the materials for the inner core and outer jacket and their relative sizes and shapes) and the composition of all of the fragments. The warhead may be configured to maximize Pk against a particular hard or soft target or to provide sufficient Pk against a variety of targets.

The mass $M_f$ of an individual preformed composite fragment is given by:

$$M_f = V_1\rho_1 + V_2\rho_2$$

where $V_1$=the volume, in percentage, of the outer jacket $V_2$=the volume, in percentage, of the inner core $\rho_1$=density of the outer jacket $\rho_2$=density of the inner core In a homogeneous configuration, the total mass $M=N*M_f$ where N is the number of preformed composite fragments 120. For a given mission, the shapes of the inner core and outer jacket, their volumes, their densities and the number N of preformed composite fragments 120 would be selected to satisfy the total mass budget M and to optimize the lethality value Pk for that mission (e.g. a particular hard or soft target or a mix of potential targets). In a heterogeneous configuration, the same principles apply with more variables for the different shapes of the preformed composite fragments and the composition of all of the fragments.

Upon contact with a "soft" target, the outer jacket 126 deforms and widens to increase the diameter of the preformed composite fragment 120. Upon contact with a "hard" target, the outer jacket 126 erodes or shatters allowing the inner core 124 to penetrate the hard target. The outer jacket 126 fully encapsulates the inner core 124 to ensure that the outer jacket 126 impacts the target regardless of orientation at impact.

Figure 2B:
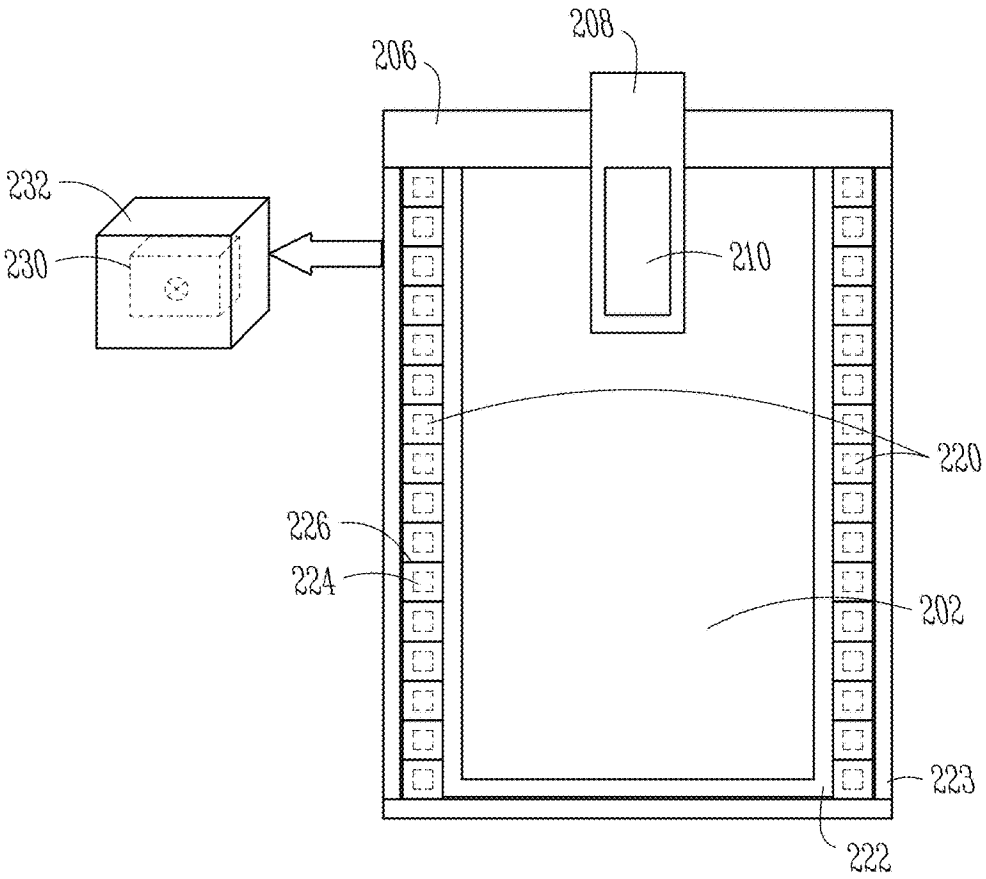
FIGS. 2A-2C are perspective and cross-section views of an embodiment of a preformed composite fragmentation warhead in which preformed composite fragments are tightly packed between the walls of the warhead casing.
Figure 2A:
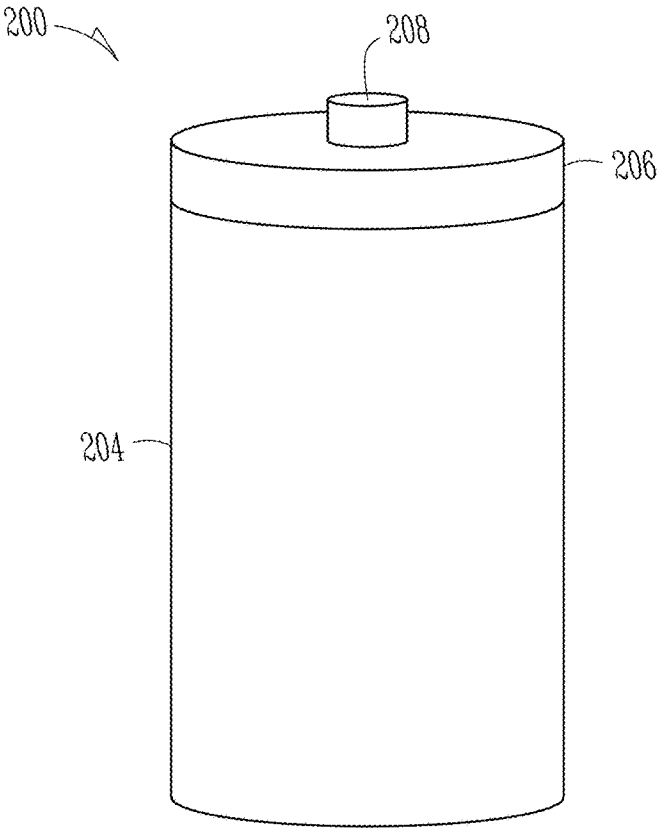
Figure 2C:
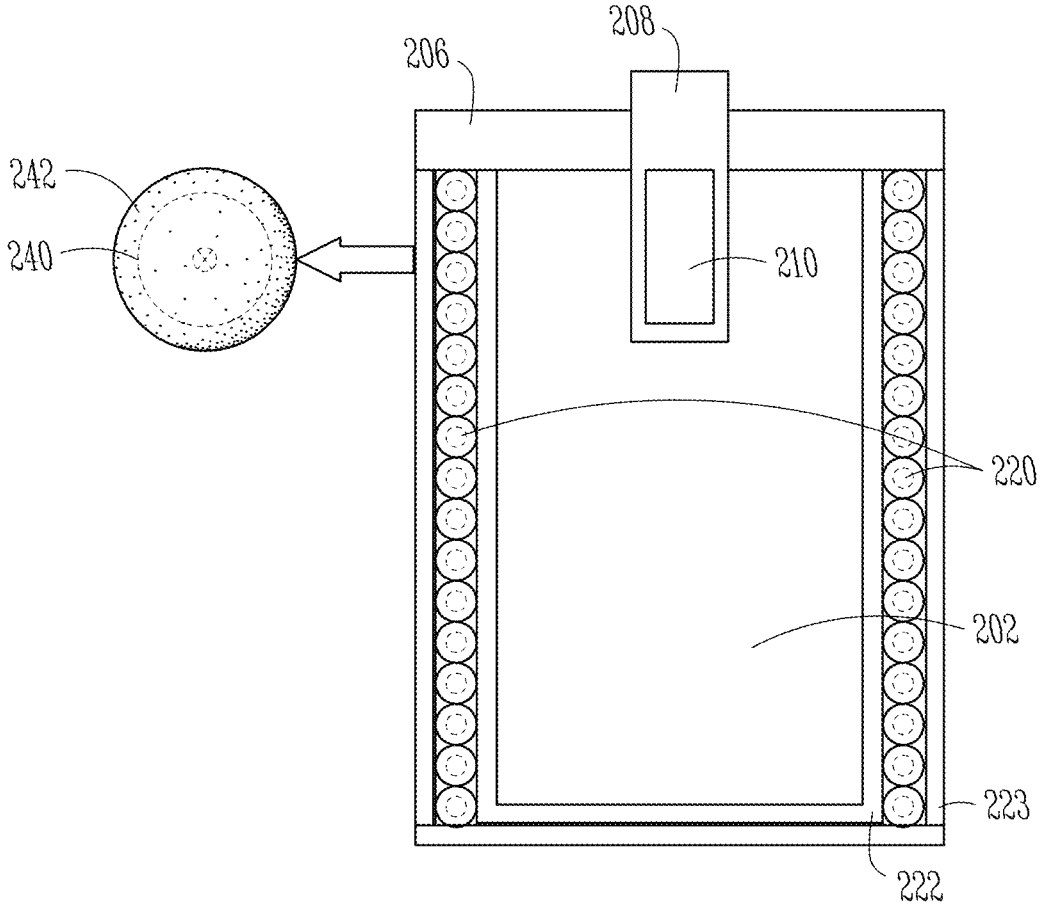

Referring now to FIGS. 2A-2C, an embodiment of a preformed composite fragmentation warhead 200 includes a high explosive 202 positioned inside a casing 204. A lid 206 is placed over high explosive 202 at an open end of casing 204. An initiation device 208, which may include a booster explosive 210 extends through lid 206 along a long axis of high explosive 202. Other configurations and initiation devices may be used to detonate the warhead.

A plurality of preformed composite fragments 220 are tightly packed around and between inner and outer walls 222 and 223 of casing 204. Each preformed composite fragment 220 includes an inner core 224 encapsulated within an outer jacket 226. The inner core 224 is formed from a material having a higher density than the material that provides outer jacket 226. As shown in FIG. 2B, the inner core and outer jacket are concentric cubes 230 and 232 that maintain the Cg of the inner core. As shown in FIG. 2C, the inner and outer jacket are concentric spheres 240 and 242 that also maintain the Cg of the inner core.

Figure 3C:
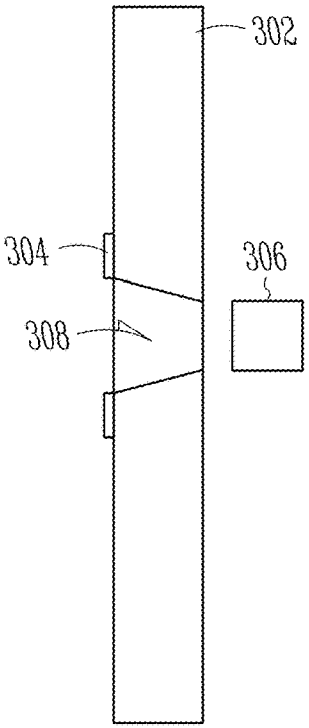
FIGS. 3A-3C illustrate a preformed composite fragment before, during and after contact with a hard target.
Figure 3B:
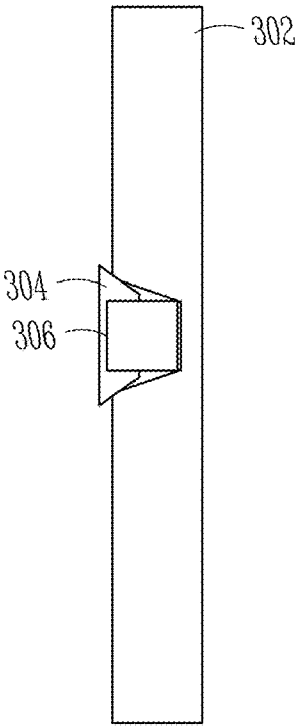
Figure 3A:
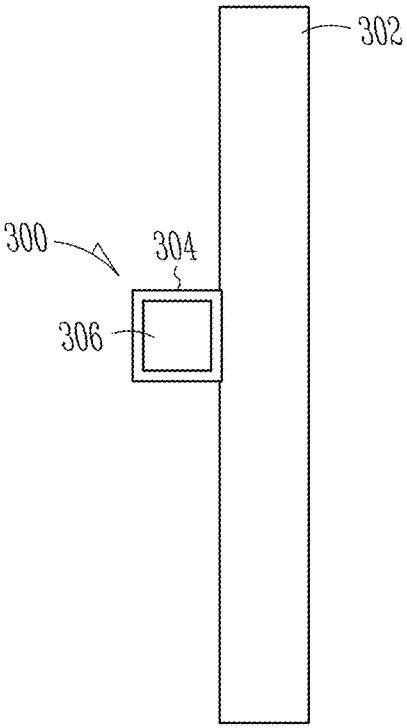

Referring now to FIGS. 3A-3C, when a preformed composite fragment 300 impacts a hard target 302 the less dense outer jacket 304 begins to erode and widen allowing the higher density inner core 306 to penetrate hard target 302 creating a larger entry hole 308. The higher density inner core 306 completely penetrates hard target 302 leaving the less dense outer jacket 304 on the surface of hard target 302.

Figure 4C:
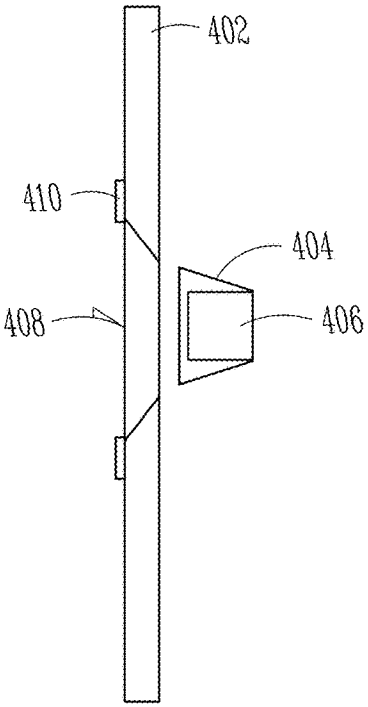
FIGS. 4A-4C illustrate a preformed composite fragment before, during and after contact with a soft target.
Figure 4B:
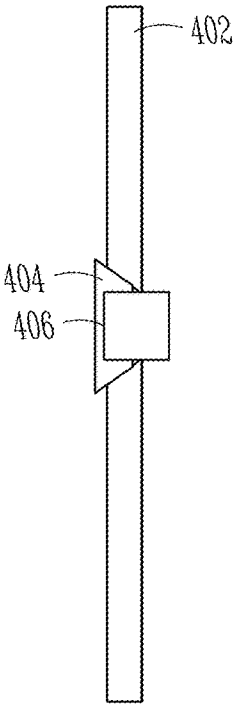
Figure 4A:
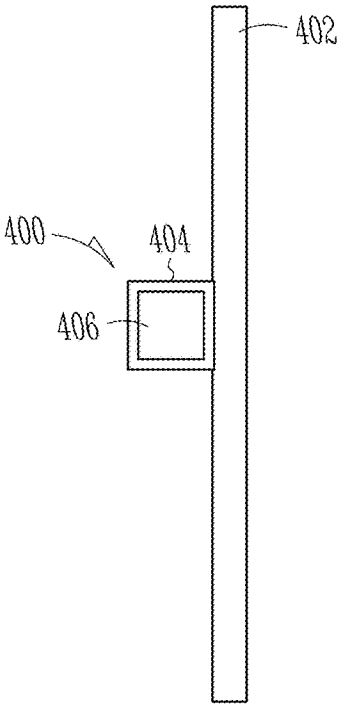

Referring now to FIGS. 4A-4C, when a preformed composite fragment 400 impacts a soft target 402 the less dense outer jacket 404 begins to erode and widen allowing the higher density inner core 406 to penetrate soft target 402 creating a larger entry hole 408. The higher density inner core 406 completely penetrates soft target 402 leaving some of the material 410 from the less dense outer jacket 404 on the surface of soft target 402. The less dense outer jacket 404 expands increasing the surface area of the fragment and the diameter of entry hole 408 and completely penetrates soft target 402 with the higher density inner core 406.

Referring now to FIGS. 5A-5E, a variety of three-dimensional different shapes of the preformed composite fragment maintain the Cg of the inner core similar to the concentric three-dimensional cubes and spheres previously illustrated.

Figure 5B:
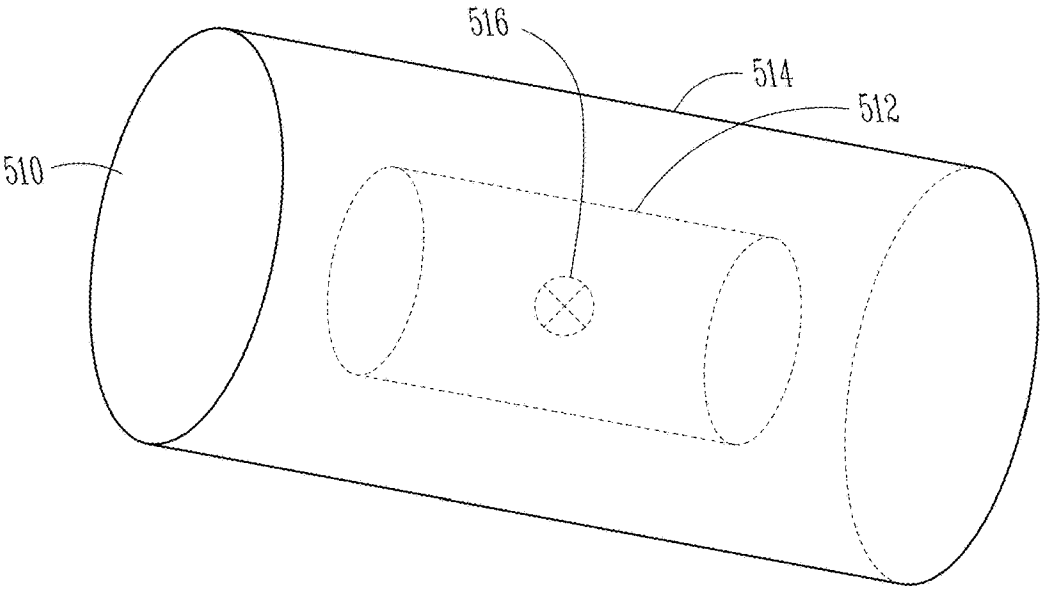
FIGS. 5A-5E illustrate different embodiments of a preformed composite fragment in which the inner core and outer jacket have the same shape.
Figure 5A:
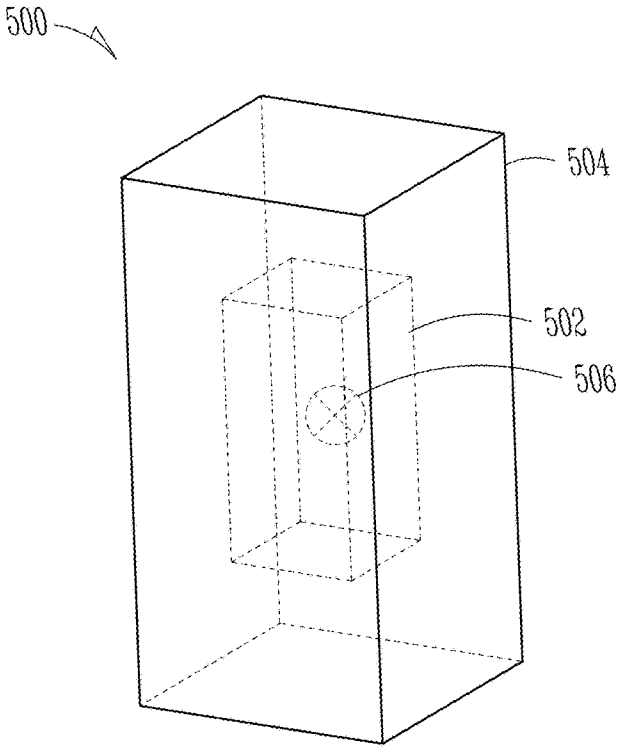

As shown in FIG. 5A, a preformed composite fragment 500 includes concentric three-dimensional rectangles that form the high-density inner core 502 and the low-density outer jacket 504 that maintain the position of Cg 506.

As shown in FIG. 5B, a preformed composite fragment 510 includes concentric three-dimensional cylinders that form the high-density inner core 512 and the low-density outer jacket 514 that maintain the position of Cg 516.

Figure 5D:
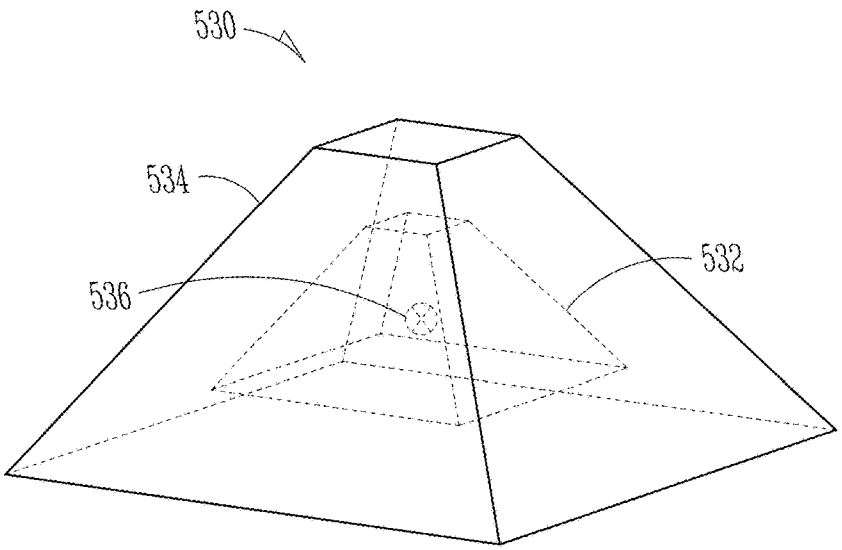
Figure 5C:
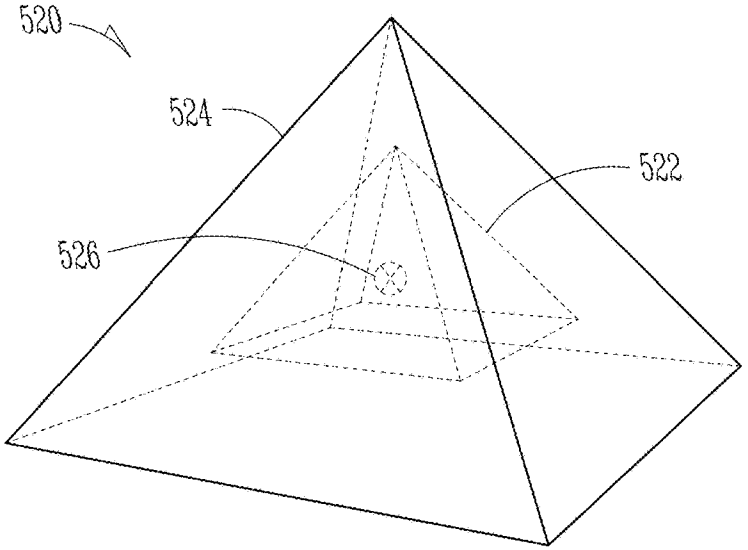

As shown in FIG. 5C, a preformed composite fragment 520 includes concentric three-dimensional pyramids that form the high-density inner core 522 and the low-density outer jacket 524 that maintain the position of Cg 526.

As shown in FIG. 5D, a preformed composite fragment 530 includes concentric three-dimensional squared-off pyramids that form the high-density inner core 532 and the low-density outer jacket 534 that maintain the position of Cg 536.

Figure 5E:
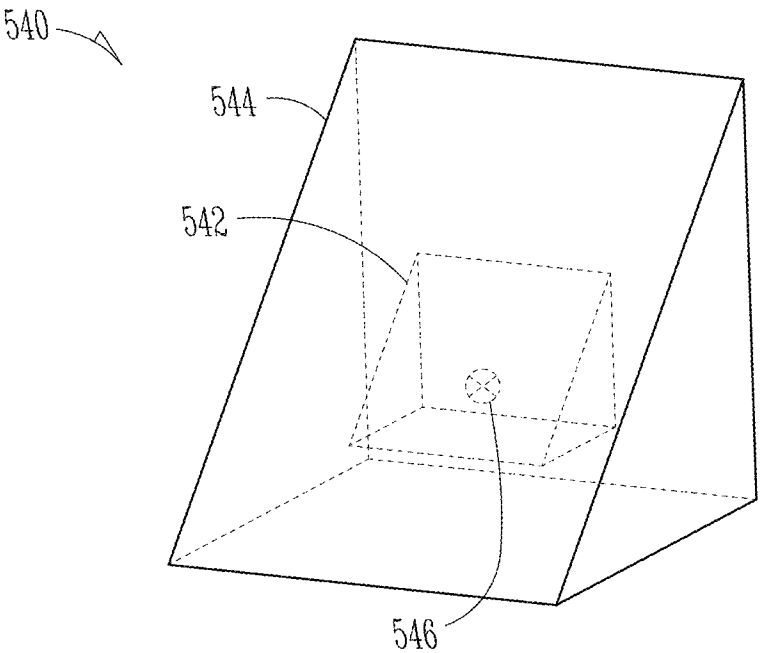

As shown in FIG. 5E, a preformed composite fragment 540 includes concentric three-dimensional right triangles that form the high-density inner core 542 and the low-density outer jacket 544 that maintain the position of Cg 546.

Figure 6:
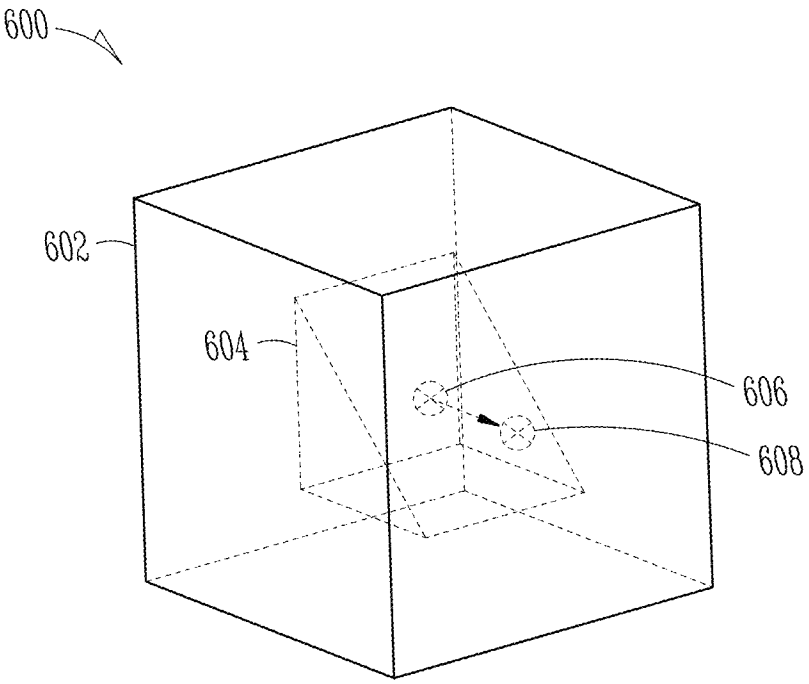
FIG. 6 illustrates an embodiment of a preformed composite fragment in which the inner core and outer jacket have different shapes to shift the Cg of the inner core.

Referring now to FIG. 6, an embodiment of a preformed composite fragment 600 in which an outer jacket 602 has a different shape than an inner core 604 to shift a Cg 606 of the inner core to a Cg 608 of the preformed composite fragment 600. In this example, a high-density three-dimensional right triangle is encapsulated in a low-density three-dimensional cube. The irregular shapes may be used to shift the Cg to provide stability in flight or to facilitate more efficient packing.

Figure 7B:
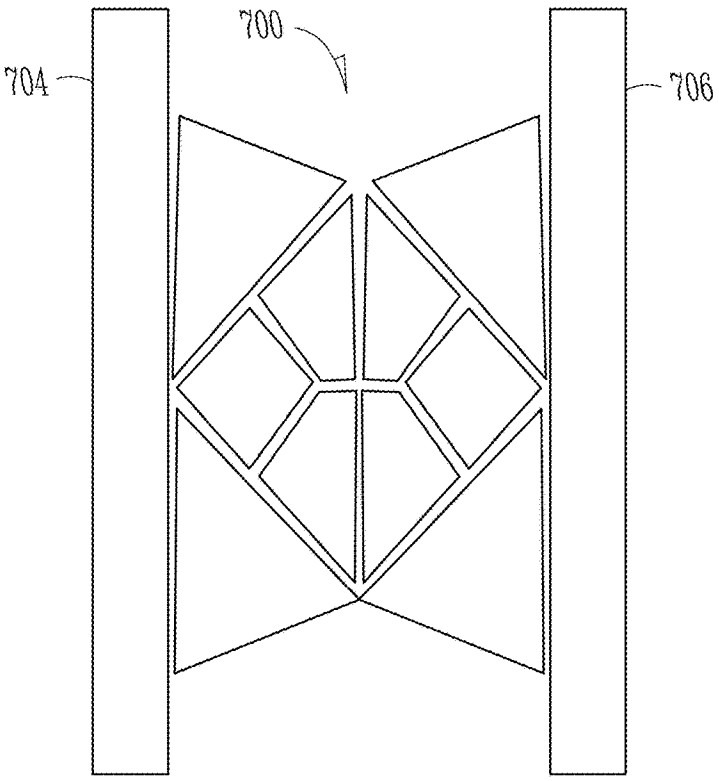
FIGS. 7A and 7B illustrate different embodiments in which different sizes and shapes of preformed composite fragments are tightly packed around the casing.
Figure 7A:
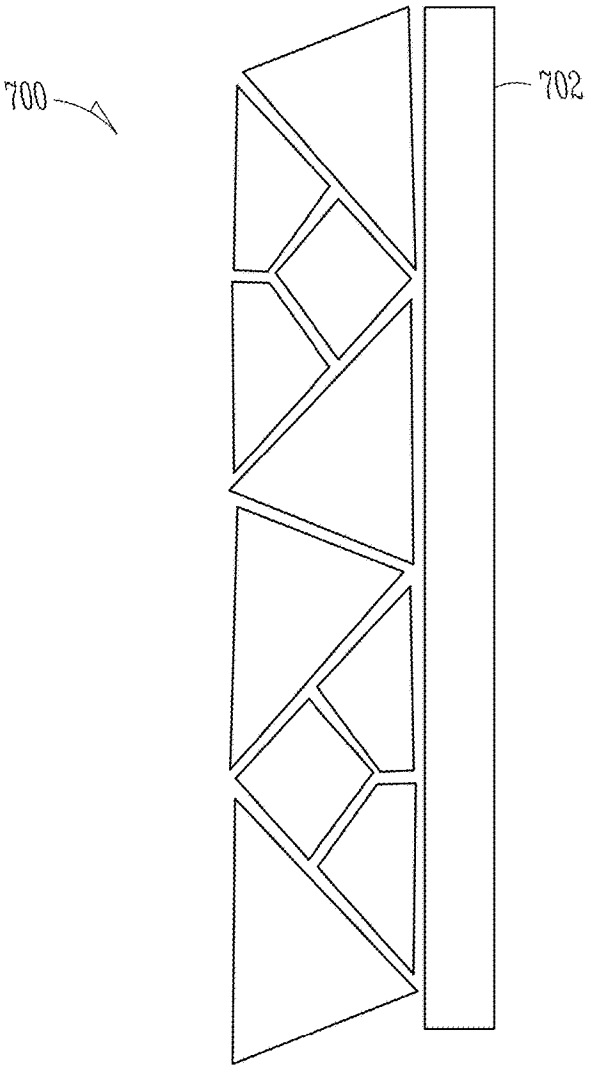

Referring now to FIGS. 7A and 7B, different embodiments are depicted in which varying sizes and shapes of preformed composite fragments 700 are tightly packed on an outer surface 702 of a casing or between the inner and outer walls 704 and 706 of a casing. The varying sizes and shapes can yield a high Pk value for a variety of hard and soft targets.

While several illustrative embodiments of the disclosure have been shown and described, numerous variations and alternate embodiments will occur to those skilled in the art. Such variations and alternate embodiments are contemplated and can be made without departing from the spirit and scope of the disclosure as defined in the appended claims.

The invention claimed is:

1. A fragmentation warhead, comprising:

a casing having an inner wall and an outer wall;

an explosive within the casing; and a plurality of preformed composite fragments packed around the casing, each said preformed composite fragment including an inner core fully encapsulated within a discrete outer jacket, said inner core formed from a first metal material having a relatively high density and said outer jacket formed from a second metal material having a relatively low density, said relatively high density being higher than said relative low density;

wherein in each said preformed composite fragment the inner core is individually encapsulated within its discrete outer jacket, wherein upon detonation of the explosive, a detonation wave travels through the plurality of preformed composite fragments propelling the preformed composite fragments including both the inner core and the discrete outer jacket towards a target.

2. The fragmentation warhead of claim 1, wherein said relatively high density is 10-23 g/cm$^3$ and said relatively low density is 2.3-9.5 g/cm$^3$.

3. The fragmentation warhead of claim 2, wherein said first metal material is selected from tungsten, molybdenum, lead, tantalum or depleted uranium, wherein said second metal material is selected from steel, aluminum, titanium or copper.

4. The fragmentation warhead of claim 1, wherein said inner core occupies 25-60% and the outer jacket occupies 40-75% for a total of 100% of a total volume of the preformed composite fragment.

5. The fragmentation warhead of claim 1, wherein the inner core has a center-of-gravity (Cg), wherein the outer jacket has the same shape as the inner core with larger dimensions than the inner core to maintain the Cg.

6. A fragmentation warhead, comprising:

a casing;

an explosive within the casing; and a plurality of preformed composite fragments tightly packed around the casing, each said preformed composite fragment including an inner core encapsulated within an outer jacket, said inner core formed from a first metal material having a relatively high density and said outer jacket formed from a second metal material having a relatively low density, said relatively high density being higher than said relative low density, wherein the inner core has a center-of-gravity (Cg), wherein the outer jacket has a different shape than the inner core to shift the Cg.

7. The fragmentation warhead of claim 1, wherein the preformed composite fragments are packed around an outer surface of the outer wall of the casing.

8. The fragmentation warhead of claim 1, wherein the preformed composite fragments are packed between the inner wall and the outer wall of the casing around the casing.

9. The fragmentation warhead of claim 1, wherein upon striking a soft target, the outer jacket widens thereby increasing the size of the fragment to penetrate the soft target.

10. The fragmentation warhead of claim 1, wherein upon striking a hard target, the outer jacket erodes leaving the inner core to penetrate the hard target.

11. The fragmentation warhead of claim 1, wherein upon detonation of the explosive, the outer jacket absorbs a high-pressure front of a detonation wave to reduce spalling of the inner core.

12. A fragmentation warhead, comprising:

a casing;

an explosive within the casing; and a plurality of preformed composite fragments packed around the casing, each said preformed composite fragment including an inner core fully encapsulated within an outer jacket, said inner core formed from a first metal material having a relatively high density and said outer jacket formed from a second metal material having a relatively low density, said relatively high density being higher than said relative low density;

wherein in each said preformed composite fragment the inner core is individually encapsulated within its discrete outer jacket, wherein upon detonation of the explosive, a detonation wave travels through the plurality of preformed composite fragments propelling the preformed composite fragments including both the inner core and the discrete outer jacket towards a target;

wherein the outer jacket absorbs high pressure of the detonation wave to reduce spalling of the inner core;

wherein upon striking the target, the outer jacket either widens thereby increasing the size of the preformed composite fragment to penetrate the target or erodes leaving the inner core to penetrate the target.

13. A plurality of preformed composite fragments for attachment to a warhead, each said preformed composite fragment comprising:

an inner core formed from a first metal material having a relatively high density; and a discrete outer jacket that fully encapsulates the inner core, said discrete outer jacket formed from a second metal material having a relatively low density, said relatively high density being higher than said relative low density;

wherein in each said preformed composite fragment the inner core is individualy encapsulated within its discrete outer jacket, wherein upon detonation of the warhead, the detonation wave travels through the plurality of preformed composite fragments propelling the preformed composite fragments including both the inner core and the discrete outer jacket towards a target.

14. The plurality of preformed composite fragments of claim 13, wherein said relatively high density is 10-23 g/cm$^3$ and said relatively low density is 2.3-9.5 g/cm$^3$.

15. The plurality of preformed composite fragments of claim 14, wherein said first metal material is selected from tungsten, molybdenum or tantalum, wherein said second metal material is selected from steel, aluminum, titanium or copper.

16. The plurality of preformed composite fragments of claim 13, wherein said inner core occupies 25-60% and the outer jacket occupies 40-75% for a total of 100% of a total volume of the preformed composite fragment.

17. The plurality of preformed composite fragments of claim 13, wherein the inner core has a center-of-gravity (Cg), wherein the outer discrete jacket has the same shape as the inner core with larger dimensions than the inner core to maintain the Cg.

18. A preformed composite fragment for attachment to a warhead, said preformed composite fragment comprising:

an inner core formed from a first metal material having a relatively high density; and an outer jacket that fully encapsulates the inner core, said outer jacket formed from a second metal material having a relatively low density, said relatively high density being higher than said relative low density, wherein the inner core has a center-of-gravity (Cg), wherein the outer jacket has a different shape than the inner core to shift the Cg.

19. The plurality of preformed composite fragments of claim 13, wherein the discrete outer jacket is configured to absorb a high-pressure front of a detonation wave to reduce spalling of the inner core;

wherein upon striking a soft target, the discrete outer jacket is configured to widen thereby increasing the size of the fragment to penetrate the soft target;

wherein upon striking a hard target, the discrete outer jacket is configured to erode leaving the inner core to penetrate the hard target.

* * * * *